US007850514B2

(12) United States Patent
Weber

(10) Patent No.: US 7,850,514 B2
(45) Date of Patent: Dec. 14, 2010

(54) INTERACTIVE SPORTS TRAINING DEVICE

(76) Inventor: Mark Weber, 645 Soudan Avenue, Toronto, ON (CA) M4S 1X7

( * ) Notice: Subject to any disclaimer, the term of this patent is extended or adjusted under 35 U.S.C. 154(b) by 885 days.

(21) Appl. No.: 11/673,288

(22) Filed: Feb. 9, 2007

(65) Prior Publication Data

US 2007/0191141 A1 Aug. 16, 2007

(30) Foreign Application Priority Data

Feb. 13, 2006 (CA) ..... 2536020

(51) Int. Cl.
*A63F 9/24* (2006.01)

(52) U.S. Cl. ..... 463/2; 463/1; 463/7; 463/36; 434/250; 434/257; 473/446; 473/269

(58) Field of Classification Search ..... 463/1, 463/7, 36, 2; 434/250, 257; 473/446, 269
See application file for complete search history.

(56) References Cited

U.S. PATENT DOCUMENTS 4,177,580 A * 12/1979 Marshall et al. ..... 434/22
5,509,650 A * 4/1996 MacDonald ..... 473/446
6,110,073 A 8/2000 Sauer et al.
6,227,968 B1 5/2001 Suzuki et al.
6,410,835 B2 6/2002 Suzuki et al.
6,575,851 B1 * 6/2003 Lamberti et al. ..... 473/435
6,695,694 B2 2/2004 Ishikawa et al.
6,786,821 B2 9/2004 Nobe et al.
6,905,413 B1 6/2005 Terao et al.
7,166,045 B1 * 1/2007 Linner et al. ..... 473/446
2003/0060340 A1 * 3/2003 Freeman ..... 482/83
2003/0216228 A1 * 11/2003 Rast ..... 482/84
2004/0043367 A1 3/2004 Chou
2004/0127285 A1 7/2004 Kavana
2005/0153265 A1 7/2005 Kavana

FOREIGN PATENT DOCUMENTS

CA 2415533 A1 6/2004

* cited by examiner

*Primary Examiner*—Pierre E Elisca
(74) *Attorney, Agent, or Firm*—Maxey Law Office, PLLC; Stephen Lewellyn

(57) ABSTRACT

An interactive sports training device has a plurality of light sources, multiple sensor means and a processor to facilitate the manoeuvring, passing and shooting of an object. Each sensor means is associated with one of the plurality of light sources, the sensor means being adapted to be triggered when an object is brought into close proximity with an activated light source. A processor means is coupled to the light sources and sensor means and is provided with at least one training program, and the processor means controls activation of the light sources according to at least one training program. When an object is placed in close proximity to an activated light source, the sensor communicates with the processor to deactivate the activated light source and to activate another light source in accordance with a training program. In use, it provides a system for simulating the unpredictable and competitive nature of multi-player sports by allowing a user to practice on his own in a 'real life' environment.

24 Claims, 7 Drawing Sheets

INTERACTIVE SPORTS TRAINING DEVICE

CROSS-REFERENCE TO RELATED APPLICATION

The present application claims priority to Canadian Application No. 2,536,020 filed Feb. 13, 2006, the teachings of which are incorporated herein by reference.

BACKGROUND OF THE INVENTION

1. Field of the Invention

This invention relates to an interactive sports training device. More particularly, this invention relates to a portable sports training device for training of hockey players and other athletes engaged in sports involving a ball, or the like, with or without a racket, or the like, and requiring accurate maneuvering, positioning, passing and shooting of the ball, or the like, including, for example, lacrosse, tennis and soccer.

2. State of the Art

For illustrative purposes only, and without limiting the applicability of the invention to other sports, reference will be made to ice hockey in explaining the invention and its advantages. This invention, however, can be applied, and can be of benefit, to any athlete who participates in any other sport involving a ball, or the like, with or without a racket, or the like, and requiring hand-eye coordination, accurate maneuvering, positioning, passing and shooting of a ball, or the like. Therefore, similar applications can be realized in many other sports, including, but not limited to, lacrosse, tennis, soccer, baseball and basketball.

Ice hockey is a sport popular in many countries around the world, including Canada, USA, Russia, Finland, Sweden, Czechoslovakia, and Germany. In Canada, where the sport was invented, it is common for players as young as three years old to begin practicing their skills.

Most competitive young players are on the ice an average of 5 hours or more per week practicing and playing. At elite levels, young players will practice two to three hours each day with at least 50% of their practice time devoted to the art of stick handling, shooting and passing.

Currently, very little competitive, individual stick handling practice is accomplished outside of the scrimmage and game situations, either on or off the ice: (i) on-ice practice—during on-ice practice, players may spend time moving the puck along and around predetermined routes usually marked by small orange cones along the ice; and (ii) off-ice practice—players will spend many hours practicing stick handling, passing and shooting in their homes, schools, parking lots, and streets using various objects such as tennis balls and rubber balls.

On-ice practice is limited by the cost of renting ice time, which is expensive and continues to climb. As a result, many players practice off-ice, either by themselves or in groups.

Currently, there are only two off-ice practice methods to simulate a real game environment. First, players practice together and invent competitive games against each other wherein each player tries to take the puck from the opposing player(s). Second, players play actual games against each other (with or without keeping score), commonly referred to as ball hockey or street hockey.

There are many difficulties to either of these methods. For example, it is often hard to find additional players of the same skill level to practice with. When one player's skills are superior to those with whom he is playing, he gets less of a 'real' practice because his skills are not challenged. Also, space constraints may severely limit players' abilities to practice their games.

On the other hand, when a player practices alone, whether on of off the ice, the player is denied the element of anticipation, unpredictability and spontaneity that is integral to developing a high level of proficiency at playing the sport. In other words, when a player practices by himself he always knows in advance precisely what his next move is going to be because he has to decide what to do and where and how to move the ball or puck. The level of challenge available in a multi-player game is simply not present when one practices alone.

On their own, players practice moving the ball from side to side as fast as they can. They can also practice passing the ball to imaginary spots as well as shooting the ball against imaginary targets, or, sometimes, into goal nets. As already noted, while engaging in any of these practices the player always knows what and where his next move is going to be. He knows in advance what he is going to do next, whether that is during stick handling, passing or shooting practice. Additionally, other than striving to complete a practice drill in a shorter time, a player has little or no competitive pressure on him while practicing on his own. While time for completion is a factor in a player's overall skill set, it is only one aspect of his proficiency. What is more important, however, is a player's ability to respond quickly and accurately to other players' unanticipated and unknown next moves—this skill, however, simply cannot be practiced or honed in individual practice. As such, a player has no accurate way to measure his performance and improvement while performing such drills.

In short, there currently is no way to practice stick handling, passing or shooting in a truly 'blind', responsive and inter-active manner; the person training always knows what he is going to do before he does it. In other words, there is no training routine that is capable of providing combined improvement of maneuverability, foot speed, hand-eye coordination, reaction time and, overall, the skills required for effective stick handling, passing and shooting in a 'real' game of hockey.

Based on the perceived need for a training device that simulates the anticipation, responsiveness and unpredictability of a multi-player game, and that improves a player's hand-eye coordination, stick handling, passing and shooting ability in an environment that closely approximates a multi-player hockey game, the training device disclosed herein was developed by the applicant.

This portable, compact and affordable invention also allows a player to practice any time and anywhere he chooses under conditions that simulate a 'real' competitive environment (otherwise only available with other players). Obtaining the same level and type of practice on one's own as was traditionally available only through multi-player activities was not possible, until now.

SUMMARY OF THE INVENTION

It is, therefore, an aspect of the invention to provide an interactive sports training device that simulates the anticipation, responsiveness and unpredictability of a multi-player sports game wherein the player is competing with or playing against other players whose strategy, movements and actions are neither known nor predictable to him by requiring the player to respond to signals, the location, frequency and occurrence of which are unknown to and unpredictable by him, and that improves a player's hand-eye coordination, stick handling, passing and shooting ability in a 'real game' environment while practicing on his own.

It is another aspect of this invention to provide such a sports training device that is compact, portable and affordable.

It is another aspect of the invention to provide an interactive sports training device that is adaptable for and capable of accommodating multiple players in time and accuracy challenges by, for example, joining several such devices either physically or wirelessly.

It is another aspect of the invention to provide an interactive sports training device that can be used by coaches and instructors to challenge players in a simulated 'real' game environment without the need for renting expensive ice time in arenas.

It is another aspect of the invention to provide an interactive sports training device that allows a player, or coach, to create new, customized programs or to practice randomly.

It is another aspect of the invention to provide an interactive sports device capable of generating endless training routines so as to prevent the boredom routinely associated with repetitive practice drills.

It is another aspect of this invention to provide an interactive sports training device that allows a player to practice in the 'dark'. In total darkness, a player will be able to see the activated light source only and will have to attempt to deactivate the light source without being able to see the ball he is moving. Currently there is no way to simulate this type of sports training.

It is another aspect of the invention to provide an interactive sports training device that is suitable for improving overall physical fitness levels.

It is another aspect of the invention to provide an interactive sports training device that allows potential customers to try out and get a 'feel' for hockey sticks in a 'real life' environment before purchasing them.

It is another aspect of the invention to provide an interactive sports training device that can be used for pay-for-play, the way, for example, batting cages and video games are currently available, at various gaming places such as, but not limited to, sports retailers, restaurants, pubs, arcades, etc.

It is another aspect of the invention to provide an interactive sports training device that can monitor elapsed time, or time for completion, calories expended, heart rate and other physical fitness indexes.

It is another aspect of the invention to provide a challenging system for shooting accurately at goal nets of different sports when a live goalie is not available.

An interactive sports training device according to the invention generally includes a (1) a mat; (2) a plurality of light sources; (3) a plurality of sensor means, the sensor means being activated upon a desired object being brought into close proximity with the light source; (4) a processor means coupled to said light sources and sensor means and provided with at least one training program; (5) an object capable of communicating with the sensor means, wherein when the object is placed in close proximity to the light source, the processor means deactivates the light and activates another one of the plurality of light sources in accordance with the at least one training program.

According to a preferred aspect of the present invention, the device (i) includes a control panel permitting a user to interact with the device, and (ii) the processor means is a microcomputer that stores predefined training programs such that the control panel can be used to select one of the programs from the microcomputer to be followed by the user. The training programs are designed to improve a user's hand-eye coordination, stick handling, object maneuvering, passing and shooting skills and accuracy. In addition, the microcomputer and display can provide feedback to the user to indicate, for example, time for completion of program, calories burned, and other health related information. The mat is 6'×6' and divided into 16"×16" units, each unit containing five (5) light sources of two different sizes: one larger light source located in the center of each unit and four (4) smaller light sources located at each of the four (4) corners of the unit. Each of these light sources is controlled independently by the processing means. By providing four (4) times as many light sources, 75% of which are smaller in size, the level of complexity of any practice drill is increased significantly. To deactivate any of these light sources, the ball has to be brought into close proximity thereto; this will require a higher degree of precision when attempting to deactivate a smaller light source. Also, such a mat is adapted to be connected to another mat, thereby increasing the surface area over which a user can practice, which, in turn, will increase the level of intensity of any practice. Similarly, such mats are capable of communicating wirelessly; therefore, multiple users can practice together in a confined space.

Another aspect of the present invention is to provide a method for improving reaction time, accuracy, agility and hand-eye co-ordination for sports in which a ball, or the like, is used, with or without a stick, or the like, consisting of the following steps: (1) detecting the unpredictable location of a signal to which a ball, or the like, must be delivered; (2) judging, based on the detected location of the signal, the optimal movement and position of the ball, or the like, to deliver the ball, or the like, to the detected location; (3) handling the racket, or the like, so as to shoot or propel the ball, or the like, to the detected location; (4) delivering the ball, or the like, to the detected location; (5) repeating the sequence of steps (1) through (4) in response to unpredictable signal locations.

These and other features and advantages of the present invention will become apparent after a review of the following drawings and detailed description of the disclosed embodiments.

BRIEF DESCRIPTION OF THE DRAWINGS

Preferred embodiments of the present invention will now be described, by way of example only, with reference to the attached Figures, wherein.

Generally, the present invention provides a system for simulating the unpredictable and competitive nature of multi-player sports that involve the maneuvering of an object (e.g., ball, hockey puck, etc.), the passing of the object, and the shooting or propelling of the object towards a goal or desired location with accuracy, thereby allowing a user to practice on his own in a 'real life' environment rather than in a predictable one. The present invention accomplishes this by requiring the player to respond to stimuli the frequency, occurrence and location of which are neither controlled nor predictable by the player, thereby requiring the player to react and respond in 'real' time as if he were responding to other players against whom he were playing. The present invention also provides a system for improving sports skills and overall physical fitness levels.

The preferred embodiment of the present invention is described herein as it would be used in connection with the sport of ice hockey, but it will be apparent from the following description that the present invention could be used for other sports involving a ball, or the like, with or without a stick, that require hand-eye coordination as well as maneuvering, manipulation and shooting of the ball, or the like.

Figure 1:
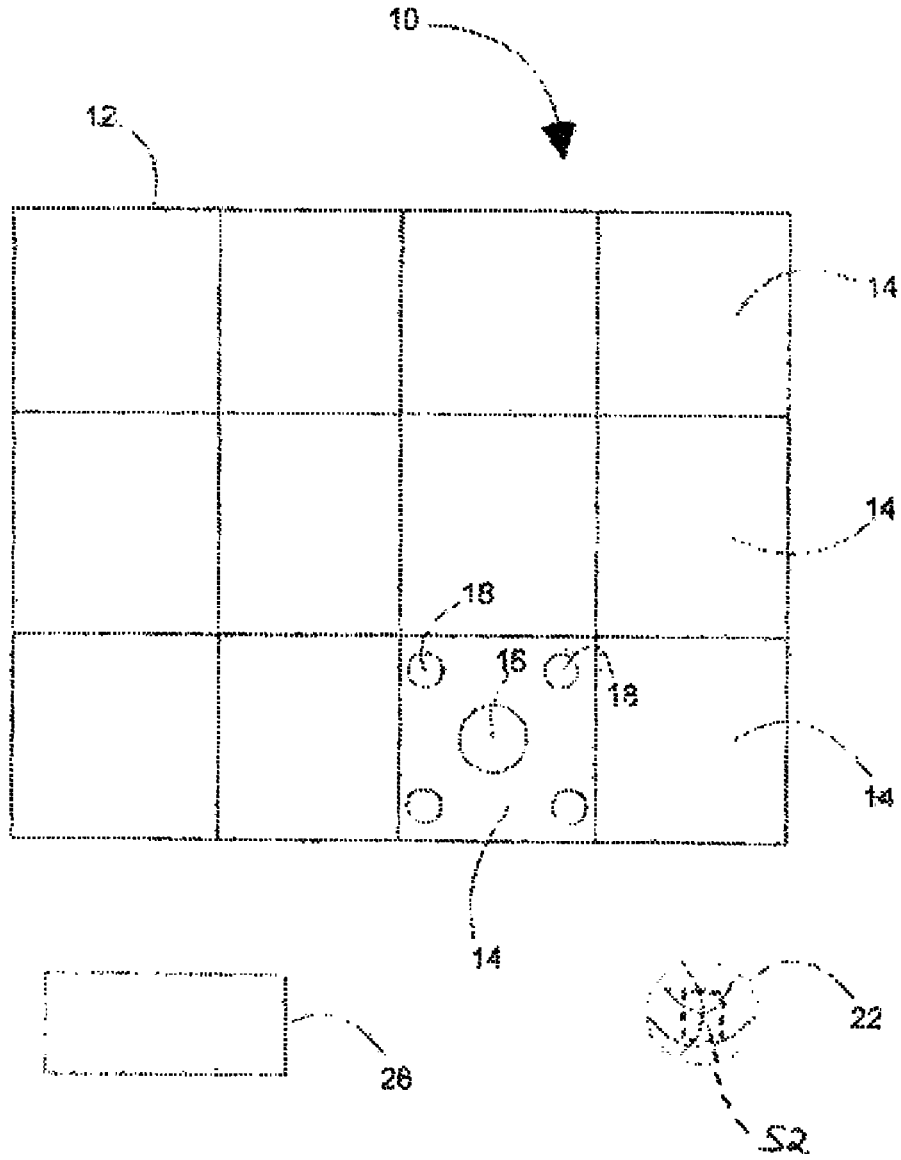
FIG. 1: is an overview of the interactive sports training device.
Figure 2:
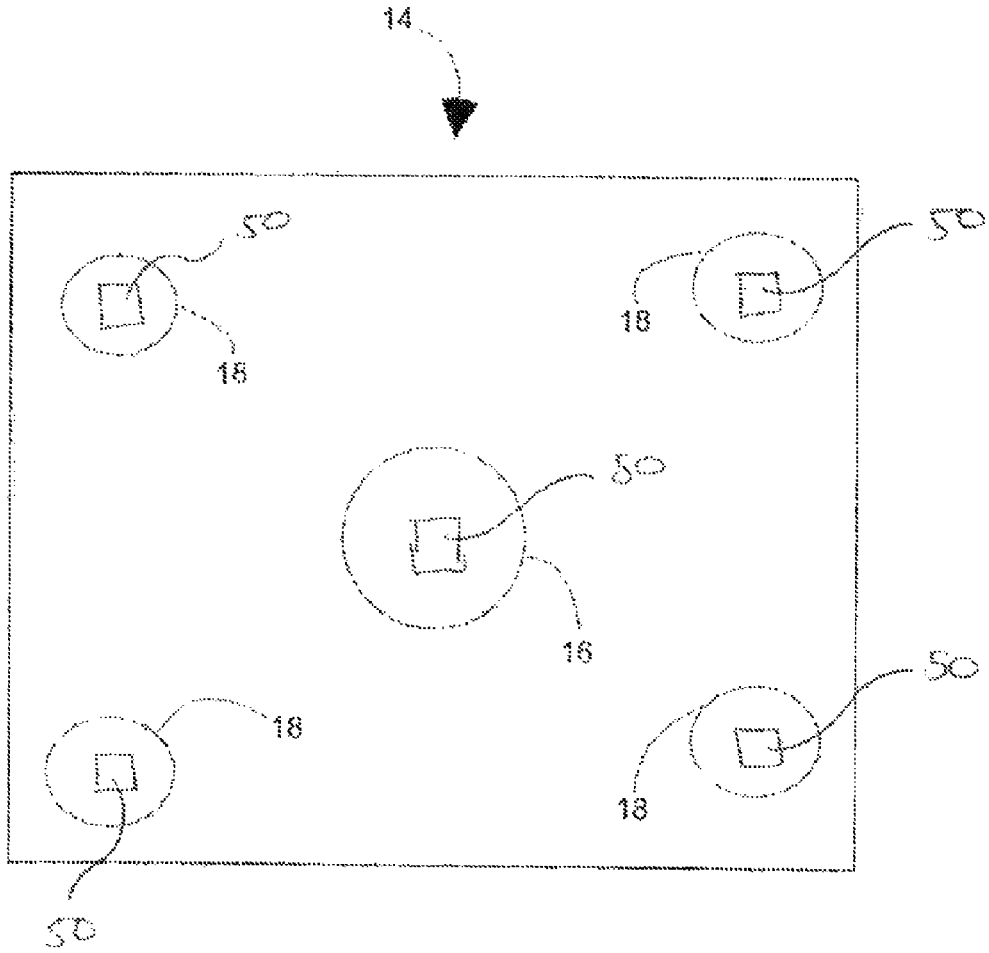
FIG. 2: is an explosion diagram of one of the twelve square units making up the mat of the interactive sports training device.

FIG. 1 shows an interactive training device [10]. The device [10] comprises a mat [12], divided into twelve square units [14], each of which contains: (A) five (5) light sources—one in the middle of the unit [16] and one in each of the four corners of the unit [18], and (B) five sensor means associated with each of the five light sources, and a processor means [20] coupled to the light sources and sensor means and provided with at least one training program, and a ball [22] capable of communicating with the sensor means; and a control panel [26]. FIG. 2 is an explosion diagram of one of the twelve square units [14] making up the mat [12].

The training program controls and dictates the frequency and order in which the light sources are activated. The training program can generate a random sequence or follow a pre-defined sequence or pattern of light source activation.

The interactive training device functions as follows: when the training program is initiated it will activate one light source. The activated light source is detected by the user who will then manipulate his hockey stick to position the ball into close proximity of the activated light source. Once that is accomplished, an object, such as a magnet, inside the ball triggers the sensor means associated with the activated light source thereby communicating to the processor means that the ball is now in close proximity to the light source. At that point, the processor generates a signal means to deactivate (turn off) the light source and activate another one. The user then detects this second activated light source, manipulates his hockey stick to re-position the ball in close proximity to the second activated light source, which triggers the second sensor means, thus signaling the processor means that the ball has been successfully repositioned; the processor means then generates another signal which deactivates this light source and turns on another one, and so on. Alternatively, the accurate and proper placement of the ball in relation to an activated light source will cause the deactivation of the light source directly, without any further communication with the processor means. When the deactivation of the light source is communicated to the processor means, the processor means causes the activation of another light source.

The interactive training device functions as follows: when the training program is initiated it will activate one light source. The activated light source is detected by the user who will then manipulate his hockey stick to position the ball into close proximity of the activated light source. Once that is accomplished, an object, such as a magnet 52, inside the ball 22 triggers the sensor means 50 associated with the activated light source 18 thereby communicating to the processor means that the ball is now in close proximity to the light source. At that point, the processor generates a signal means to deactivate (turn off) the light source and activate another one. The user then detects this second activated light source 18, manipulates his hockey stick to re-position the ball 22 in close proximity to the second activated light source 18, which triggers the second sensor means 50, thus signaling the processor means that the ball has been successfully repositioned; the processor means then generates another signal which deactivates this light source 18 and turns on another one, and so on. Alternatively, the accurate and proper placement of the ball 22 in relation to an activated light source 18 will cause the deactivation of the light source directly, without any further communication with the processor means. When the deactivation of the light source is communicated to the processor means, the processor means causes the activation of another light source.

In a further embodiment of the invention, the processor means stores data cumulatively respecting the performance of the user and calculates a result. For every time a user responds accurately within the allotted time to the light source, the user will be awarded points the total of which is calculated by the processor means upon completion of the predefined training program. The processor means is either provided with a display to exhibit this result or is adapted to transmit this result to an independent display to which it can be connected, either physically or wirelessly.

In a further embodiment of the invention, the device, or a portion thereof, can be placed (or hung) upright so that shooting and passing accuracy can be challenged further as now the ball must not only travel flat across the ground but at times be lifted or raised by the player across distances in order to trigger the sensor associated with an activated light source.

Figure 6:
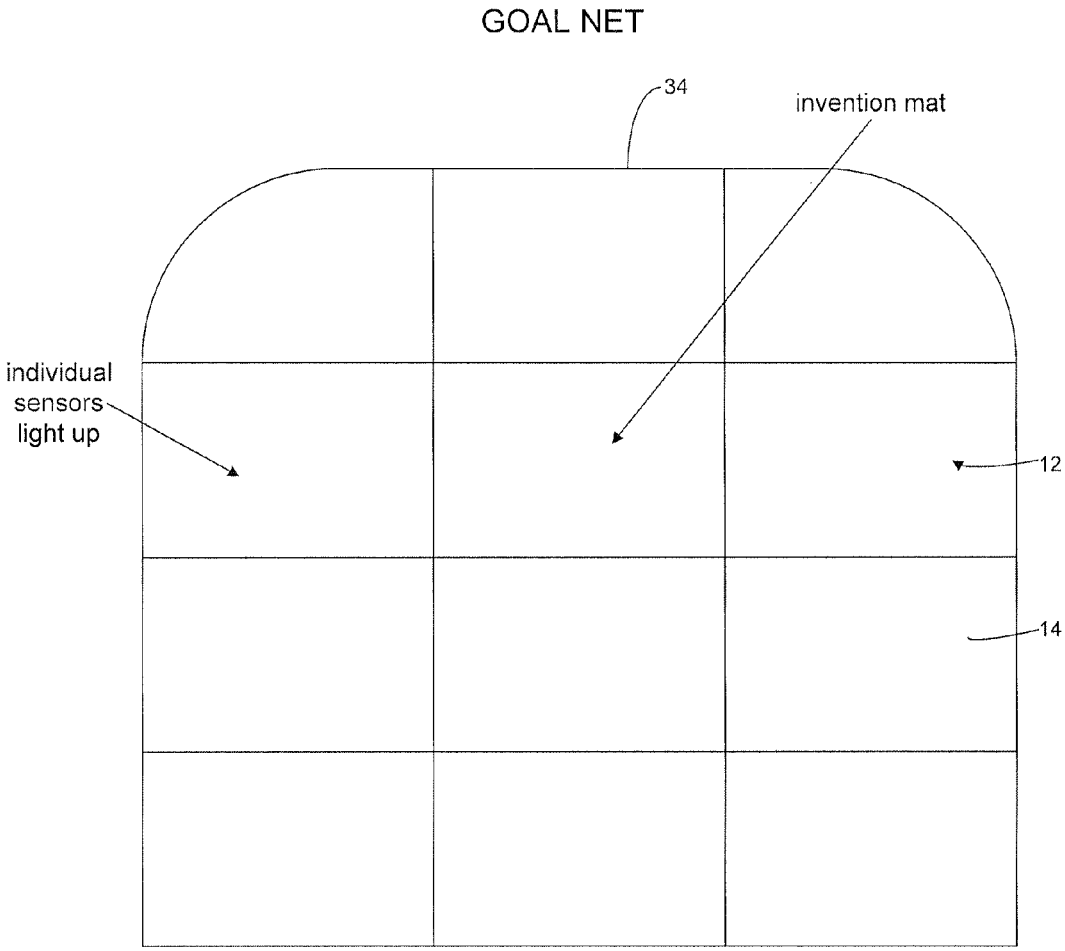
FIG. 6: is a depiction of the interactive sports training device affixed to a hockey goal.
Figure 7:
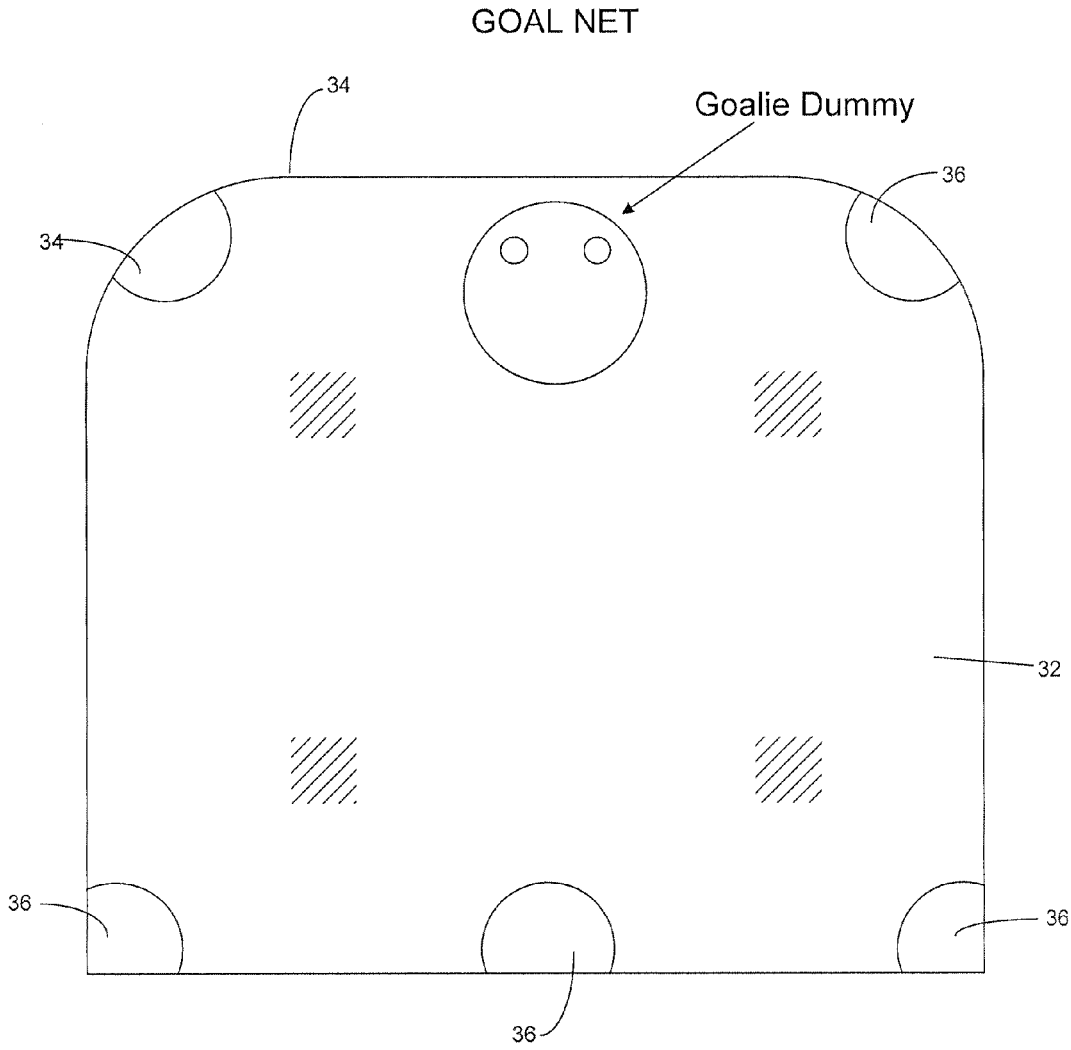
Figure 7 (Prior Art)
FIG. 7: depicts a prior art training aid that consists of an impenetrable board positioned in front of a hockey goal to completely block the net with several openings through which a player is intended to shoot the ball or puck.

The device can be attached to a hockey goal (FIG. 6) so that it completely blocks the goal net. In this mode, a player must shoot the ball at the activated light source on the mat covering the goal. In this mode, the light sources will be activated at different locations on the mat, according to a pre-defined program, or randomly, resulting in a more challenging and competitive target practice routine. This embodiment of the invention presents clear advantages over currently available training aids. FIG. 7 depicts such a prior art training aid that consists of an impenetrable board [32] positioned in front of a hockey goal [34] to completely block the net. Such a prior art device also includes several openings [36] through which a player is intended to shoot the ball or puck. The two most obvious disadvantages with such a training device are: (i) the fact that there are a limited number of stationary openings resulting in a player, in effect, always practicing the same shots; and (ii) once a player successfully shoots a ball or puck through the opening, he has to physically move the board, retrieve the ball or puck, and re-position the board to continue practicing.

Figure 5:
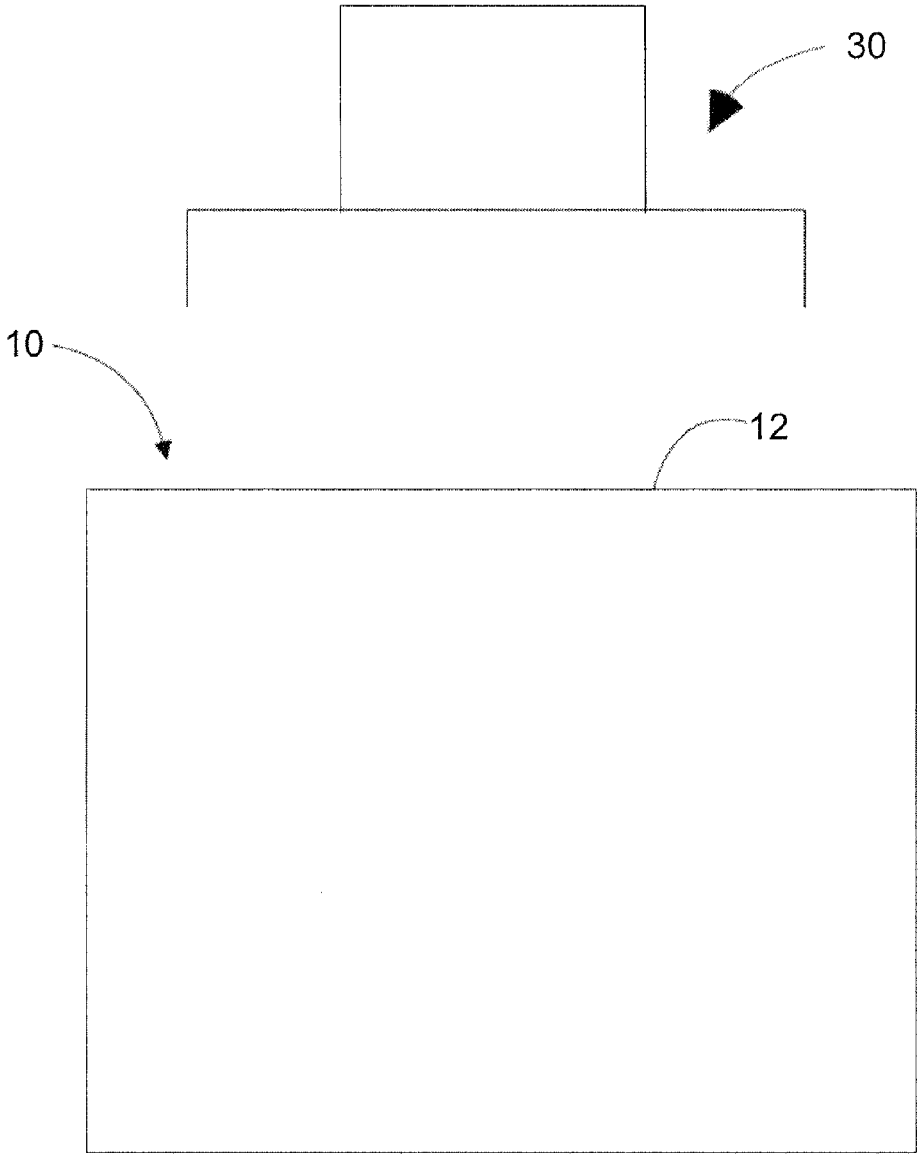
FIG. 5: is a depiction of the interactive sports training device connected to an external screen or display, such as a television.

The interactive sports training device may be operated by coupling the device to a power source, such as, but not limited to, a conventional alternating current (AC) power source, such as a conventional wall outlet, a battery, which may or may not be rechargeable, or other power sources. The interactive sports training device may then be turned on using an on/off switch. A display connected to the processor means, either physically or wirelessly, then displays a mode selection screen. FIG. 5 illustrates the sports training device [10] hooked up to an external, independent screen or display [30], for example, a television, so that the user thereof can follow the activation of the light sources on the television screen without looking a the mat [12], thereby further simulating a 'real' life hockey game. An elite player will manipulate his stick, maneuver the ball, pass it, and shoot it without looking down at the ball; he only looks up at the intermediate positions and ultimately at the final intended destination of the ball. Alternatively, the interactive sports training device may be hooked up to the internet, such that the external, independent display [30] is a computer screen, in which case, the processor means can communicate, via the internet, to display the selected predefined training program at a remote display. Alternatively, the mode of operation may be selected through the control panel [26] by entering a code or depressing pre-selected and labeled functionalities. After a mode is chosen by a user, the modes will operate as described below. The modes described below, however, are only illustrative and are neither exhaustive nor intended to represent all possible modes of operating the interactive sports training device.

Also, the following features can be incorporated into one or more of the modes for using the invention: (i) feature to select number of players; (ii) a timer (to record time and track multiple player); (iii) a score counter to record how many lights were turned off during the allotted time and track multiple players (as well as keep track of the highest scores for each pre-defined routine); (iv) a sound and/or music feature to turn sound on and off and to choose the type of music or sound to listen to; (v) a program selection feature that allows players to choose and save their favorite selections.

Figure 4:
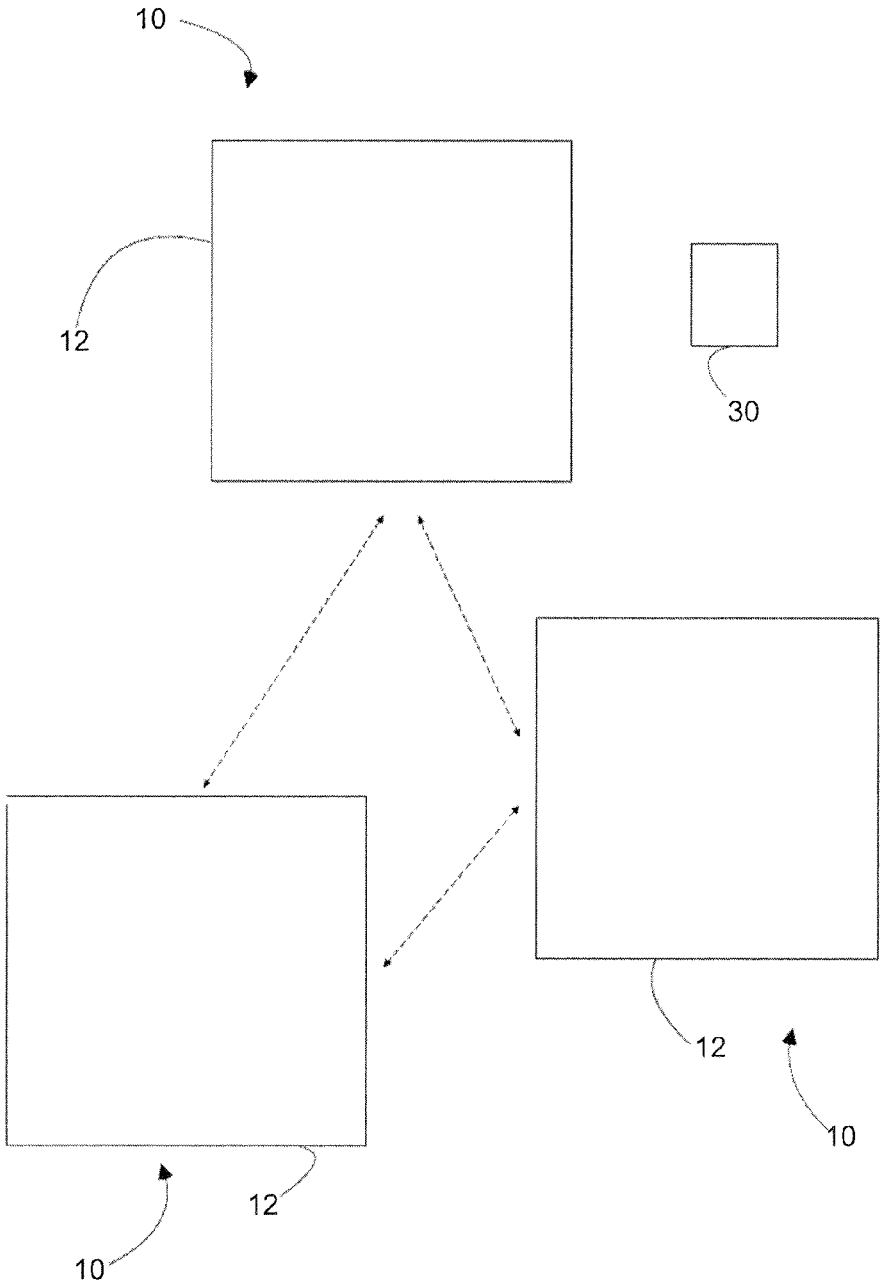
FIG. 4: is an illustration of three interactive sports training devices wirelessly joined together.

Wireless mode: Two or more mats can be located remotely, without physical connections, but rather connected wirelessly , so that players can practice their passing and stick handling skills over larger distances, as illustrated in FIG. 4. When devices are connected wirelessly, they can either function as one device, in which case a pre-defined routine will apply to all wirelessly connected devices, or as individual, yet interactive devices, in which case, for example, the same pre-defined routine is selected for each device, but time for completion is calculated for all devices.

Pass and Shoot, and Goaltender mode: Player must deactivate the light sources, which are activated in accordance with the selected predefined training routine. The activated light sources, for example, will either stay on until they are deactivated by the user (in which case, the processor means keeps track of the time it takes the user to deactivate each light source, as well as the total time for completion of the predefined training routine), or will stay on for a predetermined time only, in which case, the processor means will keep track of whether the user succeeded at deactivating the activated light source in the allotted time for doing so before having to move on to the next light source. Adjustments can be made to the random timer so that the length of time the lights stay lit before switching to another spot can be changed at the option of the player. In this mode the score counter will track how many shots or passes are hit accurately by the shooter. The processor means tracks and challenges the user by how often the light sources are deactivated during a pre-selected time. Users can increase the difficulty level and improve their accuracy by adjusting the distance between themselves and the mat.

Keepaway mode: In another mode of the invention the challenge of turning off the lights with the object can be reversed, so that the object must be kept away from the lights. In this mode the lights may randomly come on and off and it is the goal of the player to move the object away from the light as fast as possible and to continue doing so as each light comes on.

In Keepaway mode, the lights may flash quickly or with less brightness as a warning to the player to begin moving the object before the light comes to full brightness, or the light may simply shine bright but allow time for the player to move the object off the light before counting the score. The lights may randomly come on or be programmed to read where the object with the sensor is on the mat or playing surface and to turn the light on closest to the sensor so that the player feels like the light is consistently chasing him.

Figure 3:
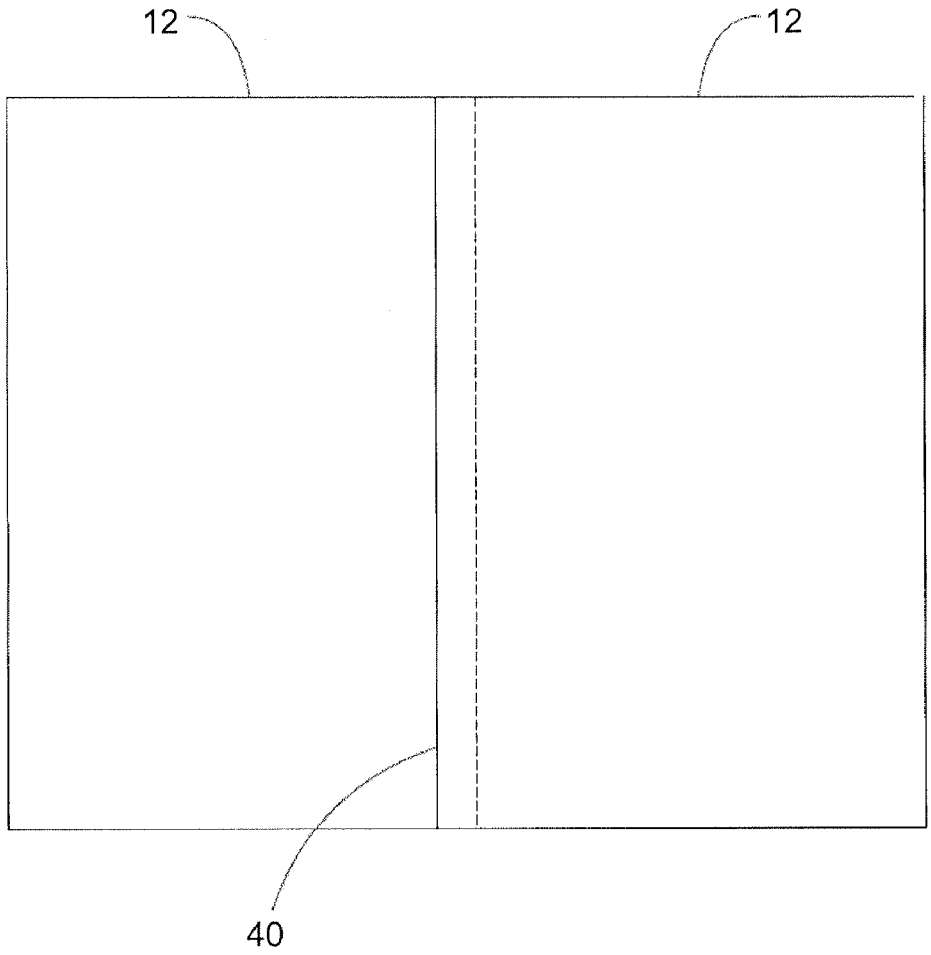
FIG. 3: is an illustration of two interactive sports training devices physically joined together.

Multi Mat: FIG. 3 illustrates two mats physically joined [40] together. When two or more mats are joined together, all of the above discussed programs and functionalities are available and the processor means adjusts accordingly. Mats can be joined physically to expand the surface area over which any one pre-defined routine is executed thereby increasing the level of difficulty of training as well as of the level of physical fitness required to complete the routine.

Also, several other modes are available, including: (i) repeat mode allowing a player to set the device to repeat any pre-defined routine or a random routine; (ii) play against time mode whereby a player will attempt to deactivate as many light sources as possible in a pre-set time; (iii) skill-level-challenge mode—how long does it take to turn off all the lights—as the skill levels increase, adjustments are made to the speed of how long and how bright the lights glow as well as to the difficulty of the distance and placement of the lights during the sequence; (iv) fun mode—each activated light source remains on until it is successfully deactivated by the user by the proper placement of the ball in close proximity to the activated light source. Once an activated light source is deactivated, another light source will be activated. In other words, the user is not constrained by a time frame within which to deactivate the light sources. The benefit of this mode still resides in the fact that a user will need to handle his stick without knowing beforehand where the ball must end up and how the user is going to get it there. In this mode, the game can be played with or without keeping track of time for completion. Alternatively, another mode can be such that each activated light source must be deactivated within a predefined time; if it is not, then it will stay on and another light source will be activated, and so on. If the user fails to deactivate any of the light sources, all light sources will end up being activated and the entire mat 'lit up'. The skill level and proficiency of a user at stick handling and maneuvering and passing the ball will be reflected by the extent to which the mat is lit up upon expiration of the allotted time for completion of this training routine ranging from a fully lit up mat (complete failure to deactivate any light source) to fully deactivated mat (complete success at deactivating all light sources).

It is preferred in this invention to ensure that the sensor 50 associated with a light source 18 is not triggered by, or does not detect, an unintended object. In particular, in the hockey training context, the sensor 50 should not be triggered by placing, or tapping, a foot or hockey stick near the sensor. Accordingly, it is desirable to provide the practice ball 22 or puck with some feature designed uniquely to be detected by the sensor 50. Many possibilities exist. For example, the ball 22 or other object maybe covered with a material designed to reflect a specific infrared, radio frequency, or other electromagnetic signal. Alternatively, the ball 22 or other object may be provided with a radio frequency identification (RFID) tag. The advantage of using an RFID tag is that if multiple balls or other objects are being used in the vicinity of the same sensor, the sensor will only detect the particular RFID tag to which it is tuned.

In a much simpler form, the sensor 50 may be able to detect metal, so that metal embedded within the ball 22 or other object will be detected. Since shoes, boots or even potentially hockey sticks or other rackets may contain metal, a slightly more sophisticated sensor would only detect magnetic fields generated by an external source. Thus, the inclusion of a magnet 52 within the ball 22 or other object can trigger a sensor 50.

In a further embodiment of the invention, the mats become semi-permanent tiles installed as a room floor. This permits a more sophisticated game to be played. A player may be required to stick handle over longer distances, or to pass to another player at some distance away. In addition, if the surface of the floor is large enough, teams of players can participate. In such a mode, hockey forwards, for example, will stick handle and pass a puck as directed by the light sources. At the same time, defensemen may attempt to block the forwards from getting the ball or other object to the light source currently lit. Thus, the forwards play not only against a clock but against opposing players and a premium on quick action, before the defensemen can move to a new light source to prevent the ball or other object from being sensed, is at a premium.

When mats are placed remotely, and it is necessary to have some electronic or electromagnetic communication between or among them, the connection can be made by hardwire, radio frequency signals, infrared signals or other known technologies.

The invention claimed is:

1. An interactive sports training device comprising:

an object having a magnet;

a body with a surface;

a plurality of light sources, each light source of said plurality of light sources visible at said surface when activated;

a plurality of sensors, one sensor of said plurality of sensors being associated with one light source of said plurality of light sources, the sensor of an activated light source detecting the magnet when said object is positioned in proximity of said activated light source;

a processor means coupled to each light source of said plurality of light sources and each sensor of said plurality of sensors, said processor means provided with at least one training program, wherein said processor means controls activation of of said plurality of light sources according to said at least one training program; and wherein when said object is placed in close proximity to an activated light source, said sensor associated with said activated light source communicates with said processor means to effect the deactivation of said activated light source and the activation of another one of said plurality of light sources in accordance with said at least one training program.

2. An interactive sports training device according to claim 1, further comprising:

a control panel, said control panel providing a user input for interacting with the device.

3. An interactive sports training device according to claim 1, further comprising:

a display, said display connected to communicate with said processor means.

4. An interactive sports training device according to claim 1, wherein said surface is vertical.

5. An interactive sports training device according to claim 1, wherein said surface is divided into a plurality of units, each unit containing two or more of said plurality of light sources, each of said two or more light sources being associated with a separate sensor of said plurality of sensors.

6. An interactive sports training device according to claim 5, wherein each unit of said plurality of units being square-shaped and including a single light source of said plurality of light sources at each corner and at a center of said unit.

7. An interactive sports training device according to claim 1, further comprising:

a goal;

and wherein said body is positioned vertical in said goal.

8. An interactive sports training device according to claim 1, wherein said object is a ball.

9. An interactive sports training device according to claim 1, wherein the device communicates with another such device wirelessly.

10. An interactive sports training device according to claim 1, further comprising:

a monitor, whereby said monitor is provided for displaying physical fitness indexes.

11. An interactive sports training device according to claim 1, wherein the device is adapted to be used with a hockey or lacrosse goal.

12. An interactive sports training device according to claim 1, wherein the device is configured to be physically connected to one or more further such devices to form a multiplicity of interconnected devices.

13. An interactive sports training device according to claim 2, further comprising:

a monitor, whereby said monitor is provided for displaying physical fitness indexes.

14. An interactive sports training device according to claim 3, further comprising:

a monitor, whereby said monitor is provided for displaying physical fitness indexes.

15. An interactive sports training device according to claim 2, wherein the device is adapted to be utilized in a vertical position.

16. An interactive sports training device according to claim 3, wherein the device is adapted to be utilized in a vertical position.

17. An interactive sports training device according to claim 10, wherein the device is adapted to be utilized in a vertical position.

18. An interactive sports training device according to claim 2, wherein the device is adapted to be used with a hockey or lacrosse goal.

19. An interactive sports training device according to claim 3, wherein the device is adapted to be used with a hockey or lacrosse goal.

20. An interactive sports training device according to claim 9, wherein the device is adapted to be used with a hockey or lacrosse goal.

21. An interactive sports training device according to claim 10, wherein the device is adapted to be used with a hockey or lacrosse goal.

22. An interactive sports training device according to claim 6, wherein the device is adapted to be used with a hockey or lacrosse goal.

23. An interactive sports training device according to claim 2, wherein the device is configured to be physically connected to one or more further such devices to form a multiplicity of interconnected devices.

24. An interactive sports training device according to claim 3, wherein the device is capable of being physically connected to one or more further such devices to form a multiplicity of interconnected devices.

* * * * *